US008235520B2

(12) United States Patent
Ushiyama

(10) Patent No.: US 8,235,520 B2
(45) Date of Patent: Aug. 7, 2012

(54) DROPLET DISCHARGE DEVICE AND DROPLET DISCHARGE METHOD

(75) Inventor: Toshihiro Ushiyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 289 days.

(21) Appl. No.: 12/713,702

(22) Filed: Feb. 26, 2010

(65) Prior Publication Data

US 2010/0238245 A1 Sep. 23, 2010

(30) Foreign Application Priority Data

Mar. 17, 2009 (JP) ..... 2009-065316

(51) Int. Cl.
*B41J 2/01* (2006.01)

(52) U.S. Cl. ..... 347/102; 101/424; 101/487; 347/19; 347/43; 347/100; 347/101

(58) Field of Classification Search ..... None
See application file for complete search history.

(56) References Cited

U.S. PATENT DOCUMENTS 5,371,531 A * 12/1994 Rezanka et al. ..... 347/43
5,732,633 A * 3/1998 Herskowits ..... 101/487
5,764,263 A * 6/1998 Lin ..... 347/101
7,954,430 B2 * 6/2011 Chretien et al. ..... 101/424.1
8,061,832 B2 * 11/2011 Gorbold et al. ..... 347/100
2007/0013757 A1 1/2007 Ohnishi
2007/0285454 A1 * 12/2007 Shang et al. ..... 347/19
2012/0001978 A1 * 1/2012 Burke ..... 347/19

FOREIGN PATENT DOCUMENTS

JP 2004-358769 A 12/2004

* cited by examiner

*Primary Examiner* — Matthew Luu
*Assistant Examiner* — John P Zimmermann
(74) *Attorney, Agent, or Firm* — Global IP Counselors, LLP

(57) ABSTRACT

A droplet discharge device includes a stage, a droplet discharge head, a movement unit and a light radiating unit. The droplet discharge head includes nozzles arranged to discharge droplets of photo-curable liquid material toward a drawing region of a workpiece. The movement unit is arranged to move the stage and the droplet discharge head relative to each other. The light radiating unit has a light emitting part capable of emitting light to an entire area of the drawing region and disposed on a side opposite from the surface of the workpiece on which the liquid material is applied. The light emitting part is arranged not to emit the light to the portion of the drawing region when the droplet discharge head is disposed at a position over the portion, and to emit the light to the portion when the droplet discharge head has moved away from the position.

11 Claims, 7 Drawing Sheets

DROPLET DISCHARGE DEVICE AND DROPLET DISCHARGE METHOD

CROSS-REFERENCE TO RELATED APPLICATIONS

This application claims priority to Japanese Patent Application No. 2009-065316 filed on Mar. 17, 2009. The entire disclosure of Japanese Patent Application No. 2009-065316 is hereby incorporated herein by reference.

BACKGROUND

1. Technical Field

The present invention relates to a droplet discharge device and to a droplet discharge method.

2. Related Art

Droplet discharge devices provided with a droplet discharge heat for discharging droplets of a liquid material are used not only in consumer applications such as inkjet printers, but also in industrial applications. Droplet discharge devices for industrial use are used for manufacturing organic EL devices, color shutters in liquid crystal display devices, and the like, and for forming metal interconnections and other conductor layers or insulation films on a substrate, for example.

Known droplet discharge devices include a device that uses a liquid material having photo-curing properties (see Japanese Laid-Open Patent Publication No. 2004-358769, for example).

In the droplet discharge device according to Japanese Laid-Open Patent Publication No. 2004-358769, for example, an inkjet head for applying a UV-curable ink to print media, and a UV radiating unit for radiating UV to the ink applied on the print media are moved over the print media. The ink applied to the print media can thereby be cured by the UV.

However, in the droplet discharge device according to Japanese Laid-Open Patent Publication No. 2004-358769, since the inkjet head and the UV radiating unit are both provided above the print media, the movement of the UV radiating unit and the print media relative to each other is affected by the limitation of relative movement between the inkjet head and the print media.

It is therefore difficult to obtain the desired UV radiation time or UV radiation timing for the ink on the print media. For example, when the print speed is increased, the UV radiation time decreases, and the ink cannot be adequately cured.

Since air is also present near the surface of the ink to which the UV is radiated by the UV radiating unit, curing of the ink is hindered by oxygen in the air, and this also prevents the ink from being adequately cured.

When the ink cannot be adequately cured, and a long time is taken between landing of the ink on the print media and the time when the UV is radiated to the landed ink, the liquid material applied on the print media spreads out, and highly precise droplet discharge cannot be realized.

SUMMARY

An object of the present invention is to provide a droplet discharge device and droplet discharge method whereby highly precise droplet discharge can be realized using a liquid material having photo-curing properties.

Such objects are achieved by the aspects of the present invention described below.

A droplet discharge device according to a first aspect includes a stage, a droplet discharge head, a movement unit, and a light radiating unit. The stage includes a mounting part configured and arranged to mount a light transmissive panel-shaped or sheet-shaped workpiece. The droplet discharge head includes a plurality of nozzles configured and arranged to discharge droplets of photo-curable liquid material toward a drawing region on a surface of the workpiece. The movement unit is configured and arranged to move the stage and the droplet discharge head relative to each other so that the droplet discharge head applies the liquid material on a portion of the drawing region and then moves away from a position over the portion of the drawing region. The light radiating unit has a light emitting part disposed on a side of the workpiece opposite from the surface on which the liquid material is applied. The light emitting part is capable of emitting light to an entire area of the drawing region. The light emitting part is configured and arranged not to emit the light to the portion of the drawing region when the droplet discharge head is disposed at the position over the portion of the drawing region, and to emit the light to the portion of the drawing region to cure the liquid material applied on the portion of the drawing region when the droplet discharge head has moved away from the position over the portion of the drawing region.

The time between application of the liquid material to the workpiece and radiation of light can thereby be reduced and made constant. Light can also be radiated to the liquid material until the liquid material applied to the drawing region of the workpiece is completely cured. Furthermore, since light is radiated from the workpiece side to the liquid material applied to the drawing region of the workpiece, inhibition of curing of the liquid material by oxygen in the air surrounding the applied liquid material can be prevented or suppressed.

Light can be prevented from reaching the nozzles of the droplet discharge head from the light emitting part. Nozzle clogging, discharge problems, and other adverse effects of curing of the liquid material near the nozzles can therefore be prevented.

The droplet discharge device of this aspect thus enables highly precise droplet discharge to be realized using a photo-curable liquid material.

Preferably, in the droplet discharge device, the light emitting part is capable of selectively switching between a lit state and an unlit state with respect to each of a plurality of areas of the light emitting part, and configured and arrange to selectively switch between the lit state and the unlit state at each of the areas based on positioning of the droplet discharge head and the stage relative to each other.

Light can thereby be radiated to a region to which the liquid material has been applied and from which the droplet discharge head has withdrawn in the drawing region, even when the droplet discharge head is present over the drawing region of the workpiece.

Preferably, in the droplet discharge device, the light emitting part is configured and arranged to set at least one of the areas facing the droplet discharge head in the unlit state, and to set at least one of the areas not facing the droplet discharge head in the lit state.

Light can thereby be directed to the liquid material that has been applied to the drawing region, while light is prevented from reaching the nozzles of the droplet discharge head from the light emitting part.

Preferably, in the droplet discharge device, the droplet discharge head is configured and arranged to apply the liquid material on a first region of the drawing region to form a first pattern, then to apply the liquid material on a second region different from the first region of the drawing region to form a second pattern, and the light emitting part is configured and arranged to set at least one of the areas corresponding to the first region in the unlit state while the first pattern is being formed by the droplet discharge head, and to set the at least one of the areas corresponding to the first region in the lit state while the second pattern is being formed by the droplet discharge head.

The time between application of the liquid material to the first region and radiation of light can thereby be reduced. Light can also be radiated to the liquid material until the liquid material applied to the first region is completely cured.

In the droplet discharge device, the first region and the second region are preferably adjacent to each other.

The time between application of the liquid material to the first region and radiation of light can thereby be further reduced.

In the droplet discharge device, the light emitting part preferably has a plurality of light-emitting elements.

The light emitting part can thereby switch between lit and unlit states for each of predetermined areas.

Preferably, in the droplet discharge device, the light emitting part is configured and arranged to control lighting and non-lighting of each of the light-emitting elements based on a drawing pattern of the liquid material formed on the drawing region.

An area (only an area for which light radiation is necessary) of the light emitting part that is in accordance with the drawing pattern can thereby be lit. Light can therefore be reliably prevented from reaching the nozzles of the droplet discharge head from the light emitting part.

The droplet discharge device preferably further includes a light transmissive cover member covering the light-emitting elements, and a surface of the cover member opposite from a surface facing the light-emitting elements forms the mounting part of the stage.

Contact between the light-emitting elements and the workpiece can thereby be prevented, and damage to the light-emitting elements, malfunctioning, and other problems can be prevented.

The droplet discharge device preferably further includes a light-diffusing member covering the light-emitting elements, and configured and arranged to diffuse light emitted from the light-emitting elements.

The light emitted from the light emitting part can thereby be prevented from becoming uneven even when the plurality of light-emitting elements is arranged in a low density.

In the droplet discharge device, the light radiating unit and the droplet discharge head are preferably configured and arranged to repeatedly alternate between application of the liquid material by the droplet discharge head to the workpiece and emission of light by the light radiating unit.

A film (layer) having increased thickness can thereby be formed.

A droplet discharge method according to a second aspect includes applying a photo-curable liquid material discharged as droplets from a plurality of nozzles of a droplet discharge head on a portion of a drawing region on a surface of a light transmissive panel-shaped or sheet-shaped workpiece mounted on a mounting part of a stage while the stage and the droplet discharge head are moved relative to each other; moving the droplet discharge head away from over the portion of the drawing region after the liquid material is applied on the portion of the drawing region; and radiating light for curing the liquid material toward the portion of the drawing region from a side of the workpiece opposite from the surface on which the liquid material is applied, in a state in which the droplet discharge head is moved away from the position over the portion of the drawing region.

The droplet discharge method of the present invention is thereby capable of realizing highly precise droplet discharge using a photo-curable liquid material.

BRIEF DESCRIPTION OF THE DRAWINGS

Referring now to the attached drawings which form a part of this original disclosure.

DETAILED DESCRIPTION OF EXEMPLARY EMBODIMENTS

Preferred embodiments of the droplet discharge device and droplet discharge method of the present invention will be described based on the accompanying drawings.

First Embodiment

A first embodiment of the present invention will first be described. An example of a case in which the present invention is applied to an industrial droplet discharge device will be described, but the present invention may also be applied to a consumer droplet discharge device such as an inkjet printer.

Figure 1:
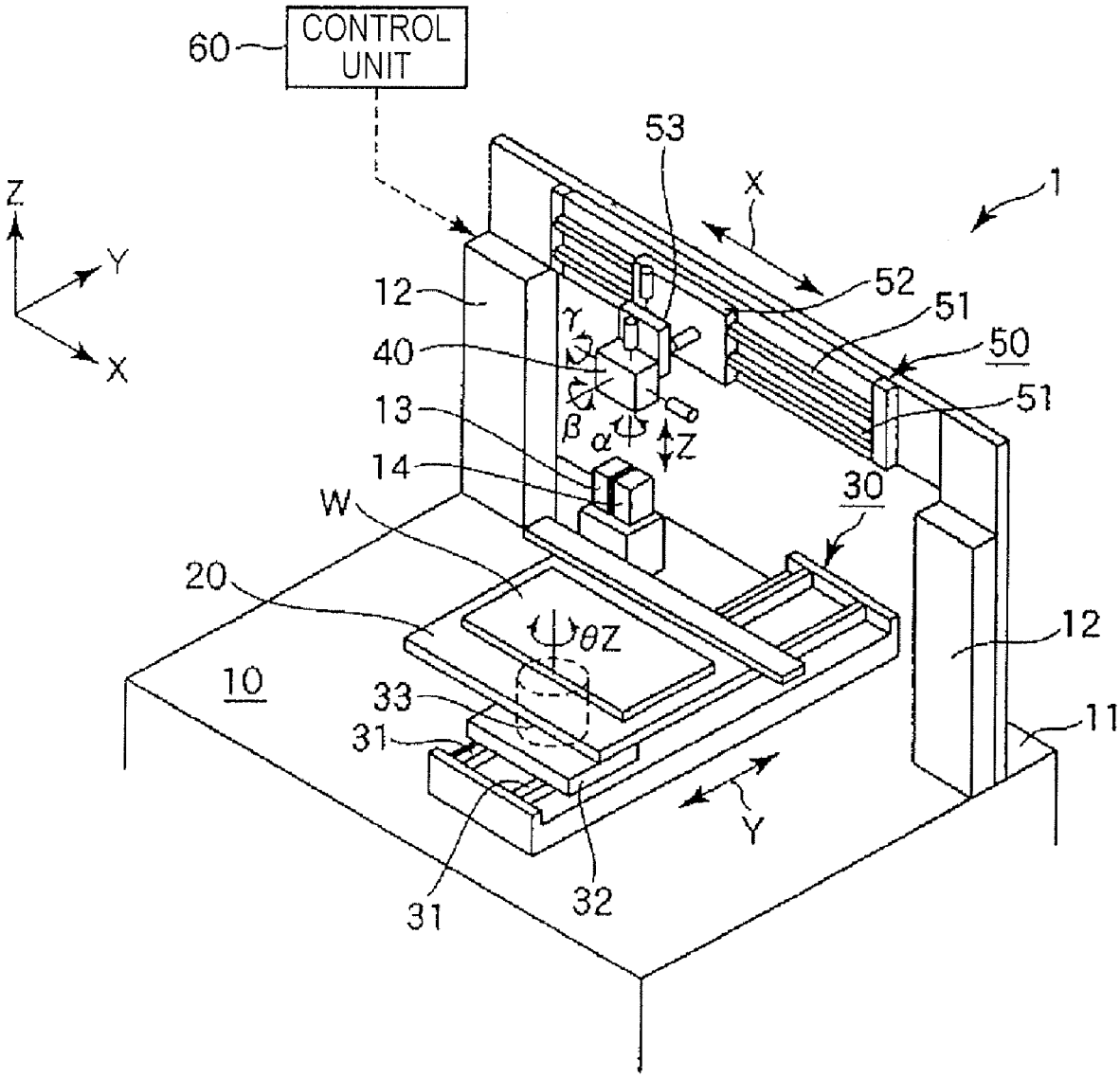
FIG. 1 is a perspective view showing the overall structure of the droplet discharge device according to a first embodiment of the present invention.
Figure 2:
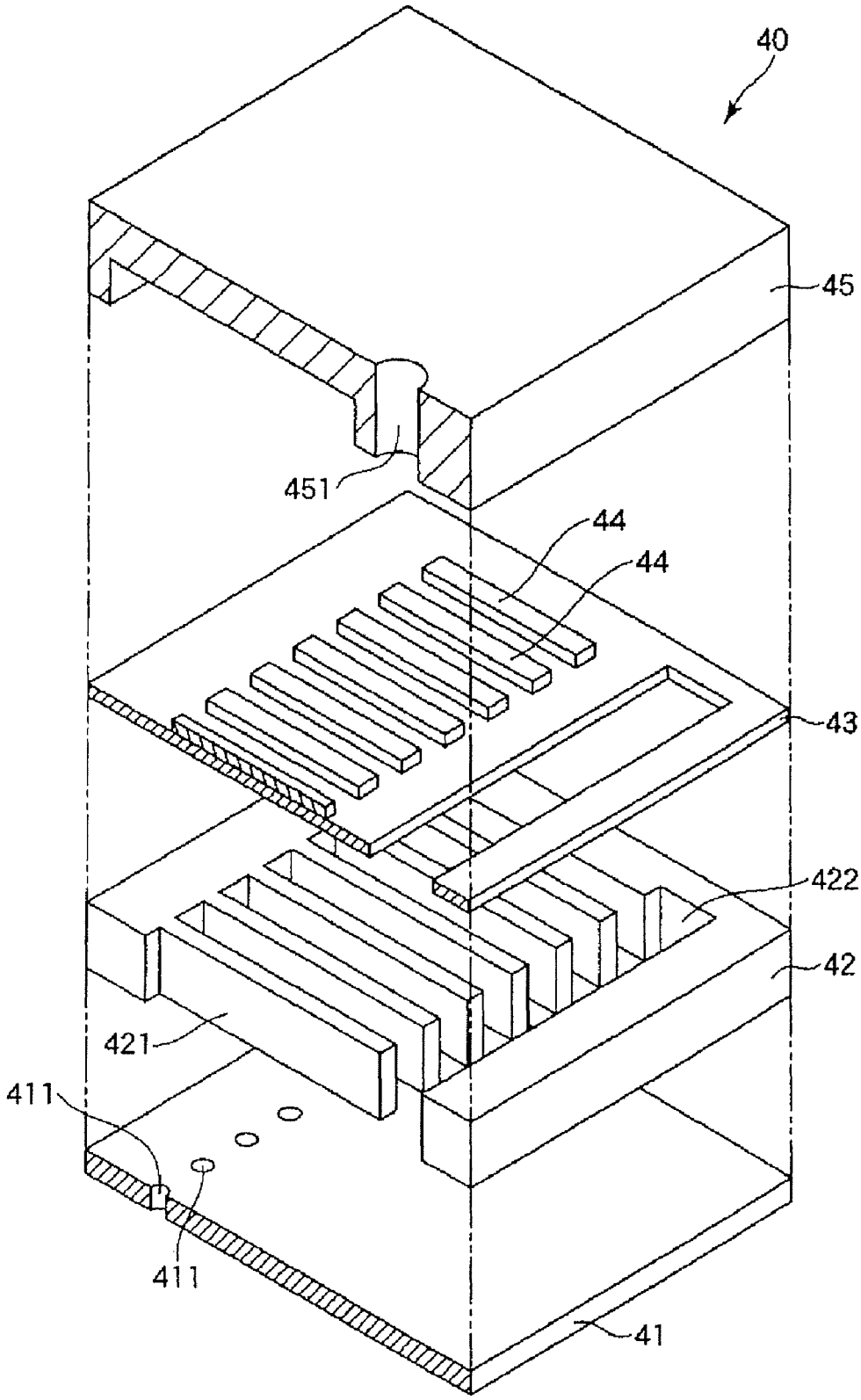
FIG. 2 is an exploded perspective view showing the overall structure of the droplet discharge head provided to the droplet discharge device shown in FIG. 1.
Figure 3:
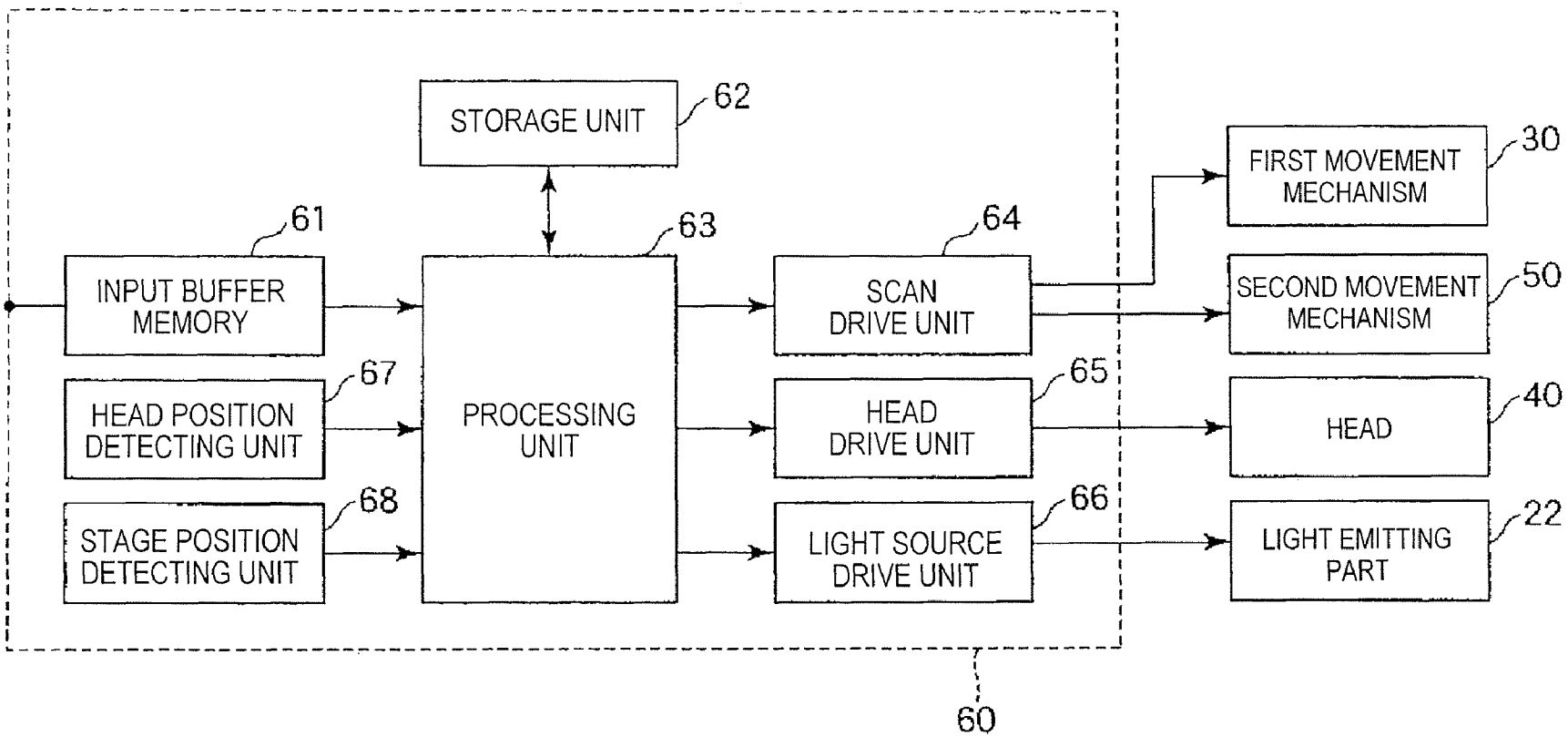
FIG. 3 is a block view showing the control system of the droplet discharge device shown in FIG. 1.
Figure 4:
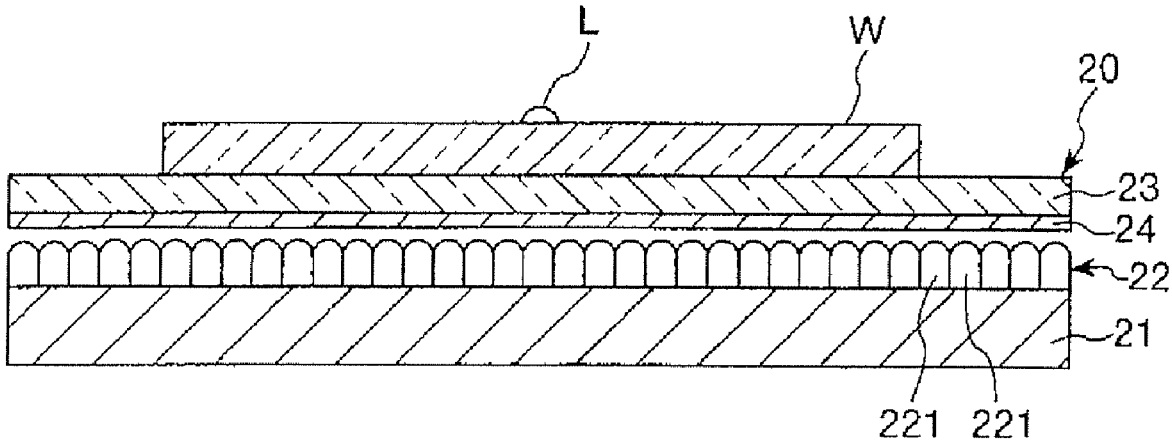
FIG. 4 is a perspective view showing the stage (light radiating unit) provided to the droplet discharge head shown in FIG. 1.
Figure 5:
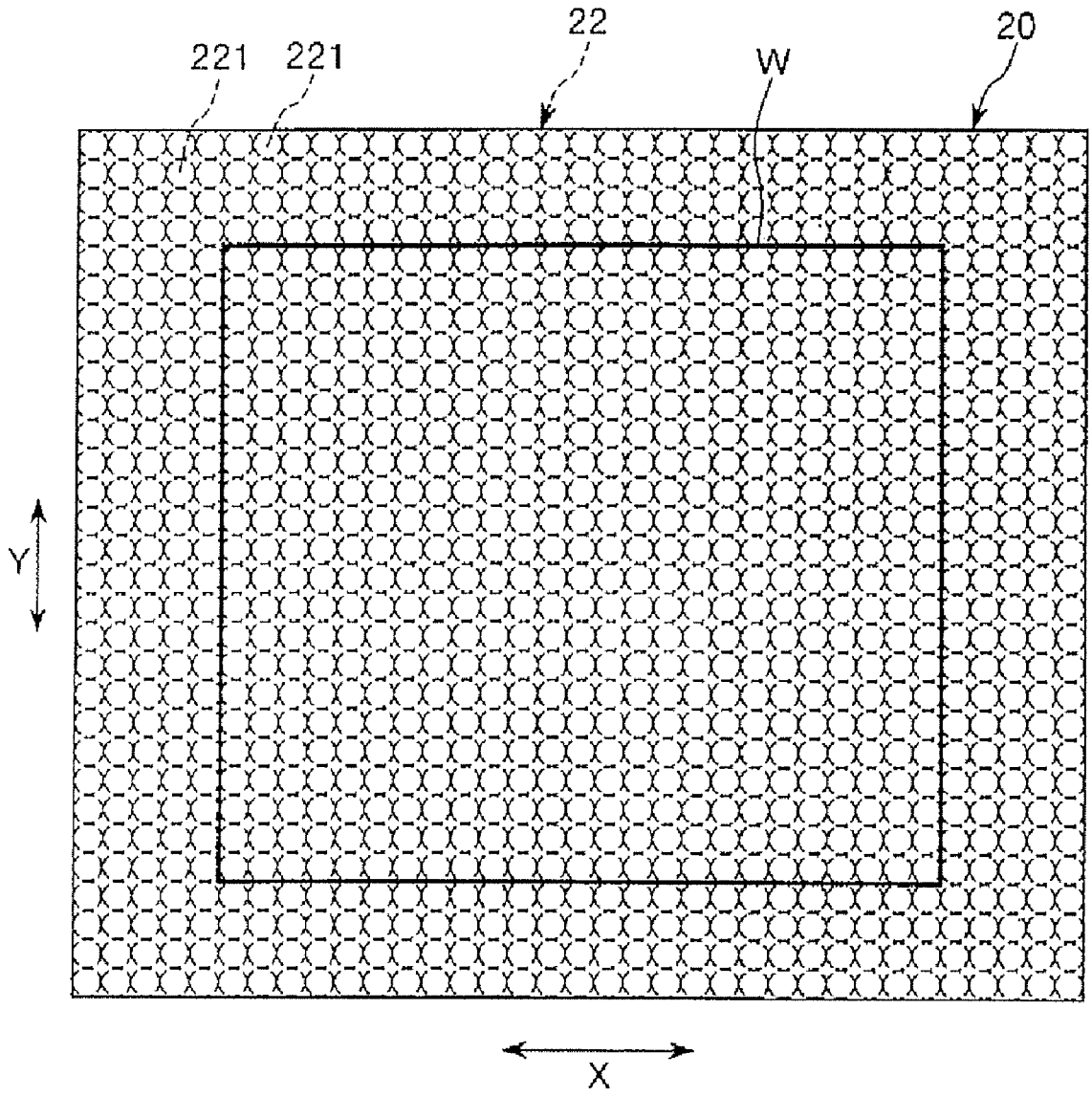
FIG. 5 is a plan view showing the stage shown in FIG. 4.
Figure 6:
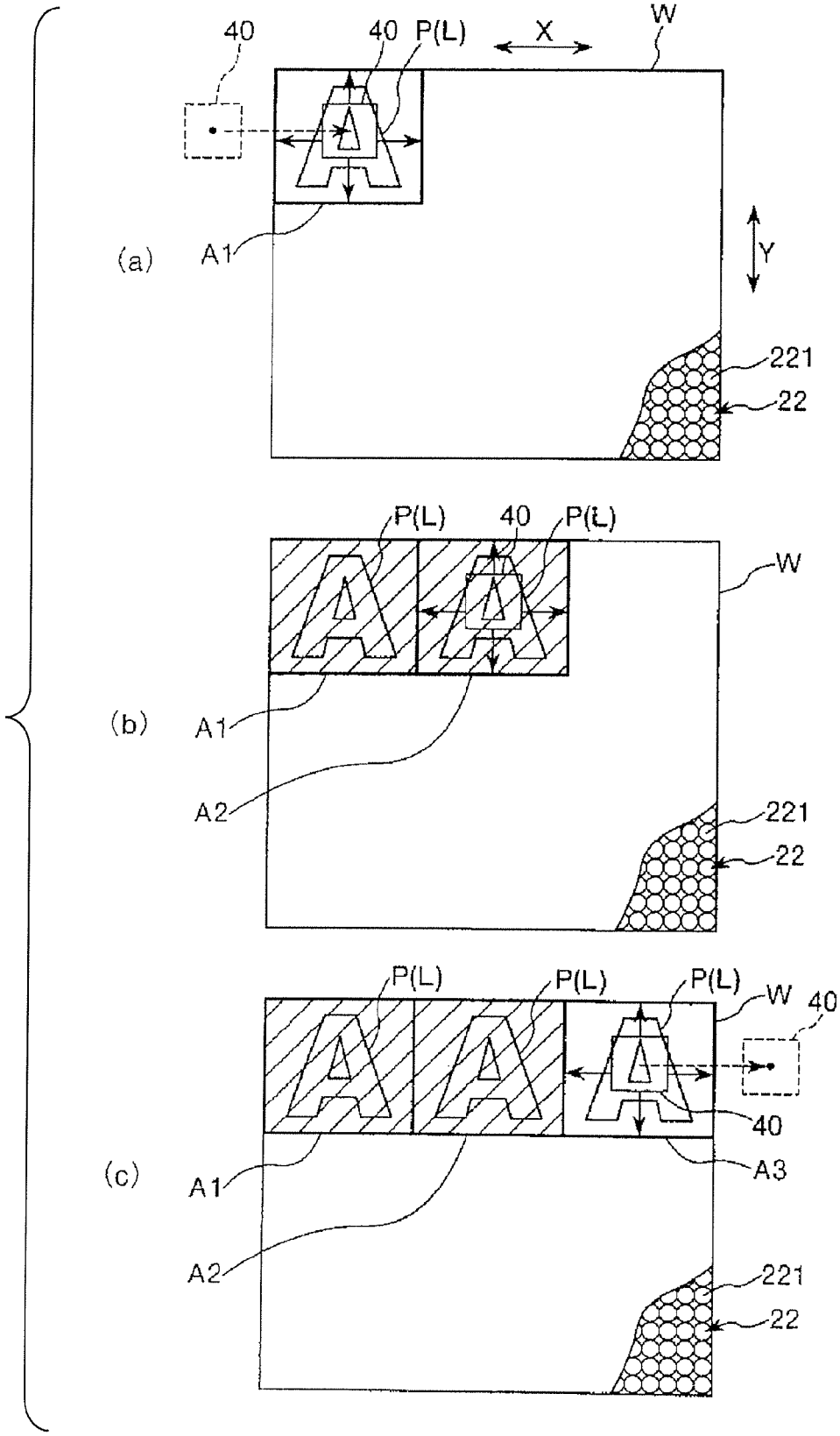
FIG. 6 is a view showing the operation of the stage shown in FIG. 4.

FIG. 1 is a perspective view showing the overall structure of the droplet discharge device according to a first embodiment of the present invention; FIG. 2 is an exploded perspective view showing the overall structure of the droplet discharge head provided to the droplet discharge device shown in FIG. 1; FIG. 3 is a block view showing the control system of the droplet discharge device shown in FIG. 1; FIG. 4 is a perspective view showing the stage (light radiating unit) provided to the droplet discharge head shown in FIG. 1; FIG. 5 is a plan view showing the stage shown in FIG. 4; and FIG. 6 is a view showing the operation of the stage shown in FIG. 4.

For the sake of convenience in the following description, the upper side in FIG. 1 will be referred to as the "top," and the lower side in FIG. 1 will be referred to as the "bottom." The up-down direction (vertical direction) in FIG. 1 will be referred to as the "Z direction," the direction (horizontal direction) perpendicular to the Z direction will be referred to as the "X direction," and the direction orthogonal to the Z direction and X direction will be referred to as the "Y direction."

Overall Structure of Droplet Discharge Device

As shown in FIG. 1, the droplet discharge device 1 has a device body 10; a stage (table) 20 on which a workpiece W is mounted; a first movement mechanism 30 (movement unit) for moving the stage 20 in relation to the device body 10 in the Y direction; a droplet discharge head 40 for discharging droplets of a photo-curable liquid material to the workpiece W; a second movement mechanism 50 (movement unit) for moving the droplet discharge head 40 in relation to the device body 10 in the X direction; and a control unit 60 for controlling the driving of each component of the droplet discharge device 1.

In the droplet discharge device 1 such as described above, while the droplet discharge head 40 is moved relative to the workpiece W in the X direction and Y direction by the action of the first movement mechanism 30 and second movement mechanism 50, droplets of the liquid material are discharged from the droplet discharge head 40 and applied (landed) on the workpiece W.

As described hereinafter, the droplets applied on the workpiece W are cured by light from a light emitting part 22 provided to the stage 20.

The components constituting the droplet discharge device 1 such as described above will be described sequentially and in detail.

As shown in FIG. 1, the device body 10 has a base 11 and a pair of columns 12 provided on the base 11.

The stage 20 is provided on the base 11 via the first movement mechanism 30.

The first movement mechanism 30 has a pair of guide rails 31 extending in the Y direction, a slider 32 capable of moving along the pair of guide rails 31, and a linear motor or other drive means (not shown) for moving the slider 32 along the pair of guide rails 31.

The stage (mounting part) 20 is attached to the top surface of the slider 32 via an adjustment mechanism 33.

The adjustment mechanism 33 includes a motor, for example, and is capable of adjusting the position and/or orientation of the stage 20 relative to the slider 32. More specifically, the adjustment mechanism 33 is capable of rotating the stage 20 in the θz direction (about an axis parallel to the Z direction) relative to the slider 32.

The stage 20 sets/retains a substrate or other workpiece W as the subject of droplet discharge (droplet application).

Although not shown in the drawings, the stage 20 is provided with a retaining unit for retaining the workpiece W in the desired position and orientation on the stage 20.

The workpiece W mounted on the stage 20 is sheet shaped or panel shaped, and is light transmissive.

In the present embodiment, the workpiece W is quadrilateral (rectangular) in planar view. The planar shape of the workpiece W is not limited to being rectangular as previously described, and may be square, triangular, pentagonal, or another polygonal shape, and may also be circular, elliptical, or another shape.

The material forming the workpiece W such as described above is not particularly limited insofar as the material is optical transparent, and resin materials, glass materials, crystals, and other materials may be suitably used.

A light emitting part 22 for emitting light capable of curing the liquid material is provided to the stage 20 so as to face upward from the lower side of the workpiece W that is retained on the stage 20 (see FIG. 4). The light can thereby be directed at the liquid material on the workpiece W via the workpiece W to cure the liquid material. The light emitting part 22 will be described in detail hereinafter.

A reserve discharge area in which the droplet discharge head 40 performs a test or trial discharge (reserve discharge) may also be provided on the stage 20.

A capping unit 13 and a cleaning unit 14 are also provided on the base 11.

The capping unit 13 covers the nozzles when the droplet discharge device 1 is in standby, so as to prevent drying of the nozzles of the droplet discharge head 40 described hereinafter.

The cleaning unit 14 suctions the insides of the nozzles in order to remove blockages of the nozzles of the droplet discharge head 40.

The droplet discharge head 40 is provided at the upper ends of the pair of columns 12 via the second movement mechanism 50.

The second movement mechanism 50 has a pair of guide rails 51 extending along the X direction, a slider 52 capable of moving along the pair of guide rails 51, and a linear motor or other drive means (not shown) for moving the slider 52 along the pair of guide rails 51.

The droplet discharge head 40 is attached to the slider 52 via an adjustment mechanism 53.

The adjustment mechanism 53 includes a plurality of motors, for example, and is capable of adjusting the position and/or orientation of the droplet discharge head 40 relative to the slider 52. More specifically, the adjustment mechanism 53 has the functions of moving the droplet discharge head 40 relative to the slider 52 in the Z direction, rotating the droplet discharge head 40 relative to the slider 52 in the α direction (about an axis parallel to the Z direction), rotating the droplet discharge head 40 relative to the slider 52 in the β direction (about an axis parallel to the Y direction), and rotating the droplet discharge head 40 relative to the slider 52 in the γ direction (about an axis parallel to the X direction).

The droplet discharge head 40 discharges droplets D of a photo-curable liquid material L toward a drawing region on one surface (top surface) of the workpiece W mounted on the aforementioned stage 20. The drawing region is a region capable of receiving application of droplets D from the droplet discharge head 40. In the present embodiment, the drawing region is described as the entire area (substantially the entire area) of the top surface of the workpiece W, but the drawing region may also be a portion of the top surface of the workpiece W.

A piezo scheme using piezo elements is employed in the droplet discharge head 40, and the droplet discharge head 40 has a nozzle substrate 41, a cavity substrate 42, an oscillation plate 43, a plurality of piezoelectric elements 44, and a cover substrate 45.

The nozzle substrate 41 and the oscillation plate 43 are joined via the cavity substrate 42.

Irregularly shaped holes that pass through in the thickness direction are formed in the cavity substrate 42, and a plurality of cavities 421 and a reservoir 422 that communicates with the plurality of cavities 421 are thereby formed between the nozzle substrate 41 and the oscillation plate 43.

A plurality of nozzles (nozzle holes) 411 is formed in the nozzle substrate 41 so as to correspond to the aforementioned plurality of cavities 421.

A plurality of piezoelectric elements 44 is joined to the surface of the oscillation plate 43 on the opposite side thereof from the cavity substrate 42 so as to correspond to the aforementioned plurality of cavities 421. Driving of the piezoelectric elements 44 is controlled by the aforementioned control unit 60.

The cover substrate 45 is joined to the surface of the oscillation plate 43 on the opposite side thereof from the cavity substrate 42. A concave part is formed in the cover substrate 45 so as to accommodate the plurality of piezoelectric elements 44, and the edges of the cover substrate 45 are joined to the oscillation plate 43. A feed hole 451 communicating with the aforementioned reservoir 422 is formed in the cover substrate 45.

Although not shown in the drawing, a tank for storing the liquid material L is connected to the feed hole 451 via a feed duct. The liquid material L is thereby fed from the tank to the reservoir 422 of the droplet discharge head 40 via the feed duct.

In the droplet discharge head 40 configured as described above, driving the piezoelectric elements 44 causes the portions of the oscillation plate 43 that correspond to the driven piezoelectric elements 44 to deform (oscillate). The volume (pressure) of the cavities 421 that corresponds to the driven piezoelectric elements 44 thereby changes, and the liquid material L is discharged (ejected) in the form of droplets D through the nozzles 411 from within the cavities 421.

The liquid material L is photo-curable.

The type of liquid material L is determined by the application or other characteristics of the droplet discharge device 1 and is not particularly limited insofar as the liquid material L is photo-curable. Various solutions dissolved in an organic material as a solvent, and various liquid dispersions in which an organic or inorganic material as a dispersoid is dispersed in a dispersion medium may be used as the liquid material L.

The droplet discharge head 40 is not limited to employing a piezo scheme, and may employ a scheme in which droplets of the liquid material are discharged by bubbles formed by heating the liquid material, an electrostatic drive scheme in which the oscillation plate 43 is driven by electrostatic attraction, or another scheme.

The driving of the first movement mechanism 30, second movement mechanism 50, and droplet discharge head 40 such as described above is controlled by the control unit 60. The control unit 60 has the function of controlling driving of the light emitting part 22 described hereinafter.

As shown in FIG. 3, the control unit 60 such as described above is provided with an input buffer memory 61, a storage unit 62, a processing unit 63, a scan drive unit 64, a head drive unit 65, a light source drive unit 66, a head position detecting unit 67, and a stage position detecting unit 68.

The input buffer memory 61 and the processing unit 63 are connected so as to be able to communicate with each other. The processing unit 63 and the storage unit 62 are connected so as to be able to communicate with each other. The processing unit 63 and the scan drive unit 64 are connected so as to be able to communicate with each other. The processing unit 63 and the head drive unit 65 are connected so as to be able to communicate with each other. The scan drive unit 64 is connected to the first movement mechanism 30 and second movement mechanism 50 so as to enable mutual communication. The head drive unit 65 is connected to each of a plurality of droplet discharge heads 40 so as to enable mutual communication. The light source drive unit 66 and the light emitting part 22 are also connected so as to be able to communicate with each other.

The input buffer memory 61 receives data relating to a position at which droplets of the liquid material L are discharged, i.e., drawing pattern data, from an external information processing device not shown in the drawing. The input buffer memory 61 inputs the drawing pattern data to the processing unit 63, and the processing unit 63 stores the drawing pattern data in the storage unit 62. The storage unit 62 is composed of RAM, a magnetic storage medium, a magneto-optical storage medium, or the like.

The head position detecting unit 67 detects the position (movement distance) of the droplet discharge head 40 in the X direction and inputs a detection signal to the processing unit 63.

The stage position detecting unit 68 detects the position (movement distance) of the stage 20 (and workpiece W) in the Y direction and inputs a detection signal to the processing unit 63.

The head position detecting unit 67 and the stage position detecting unit 68 are each composed of a linear motor, laser measuring machine, or the like, for example.

The processing unit 63 controls (by closed-loop control) the operation of the first movement mechanism 30 and second movement mechanism 50 via the scan drive unit 64 based on the detection signals of the head position detecting unit 67 and the stage position detecting unit 68. The relative movement speed and the positioning of the droplet discharge head 40 and the workpiece W relative to each other in the X direction and Y direction are thereby controlled.

The processing unit 63 presents to the head drive unit 65 a selection signal for specifying the on/off state of droplet discharge for each discharge timing of a predetermined time interval corresponding to each of the nozzles 411 of the droplet discharge head 40 described hereinafter, based on the abovementioned drawing pattern data. The head drive unit 65 presents a discharge signal necessary for discharge of the liquid material L to the droplet discharge head 40 based on the abovementioned selection signal. As a result, droplets of the liquid material L are discharged from the corresponding nozzles 411 in the droplet discharge head 40.

Based on the detection signals of the head position detecting unit 67 and stage position detecting unit 68, and/or the abovementioned drawing pattern data, the processing unit 63 causes the light source drive unit 66 to generate the drive signal of the light emitting part 22 and controls the driving of the light emitting part 22. The control unit 60 can thereby control the driving of the light emitting part 22 based on the positional relationship (relative positional relationship) between the droplet discharge head 40 and the stage 20, and/or the discharge pattern (drawing pattern) of droplets D by the droplet discharge head 40.

The control unit 60 is a computer that includes a CPU, ROM, and RAM, for example. In this case, the functions of the control unit 60 such as described above can be realized through the use of a software program executed by the computer. Of course, the control unit 60 may also be a dedicated circuit (hardware).

Light Radiating Unit of Droplet Discharge Device

The light radiating unit of the droplet discharge device 1 will next be described in detail.

As shown in FIG. 4, the stage 20 has a plate-shaped stage body 21, the light emitting part 22 provided on one surface (top surface) of the stage body 21, a light transmissive cover member 23 provided on the side of the light emitting part 22 opposite the stage body 21, and a light diffusing member 24 provided on the surface of the cover member 23 facing the light emitting part 22.

In the stage 20 such as described above, the light emitting part 22 emits light to the side opposite the stage body 21 (upward), and the light passes through the light diffusing member 24, the cover member 23, and the workpiece W in sequence, and is radiated to the liquid material L on the workpiece W.

The stage 20 herein constitutes a light radiating unit for radiating light for curing the liquid material L to the liquid material L that is applied to the drawing region of the workpiece W.

In particular, when the droplet discharge head 40, after having applied the liquid material L on at least a portion of the drawing region, has withdrawn from the region, the light emitting part 22 is configured so as not to emit light to the region when the droplet discharge head 40 is present over the region, and to emit light to the region when the droplet discharge head 40 has withdrawn from over the region.

The time between application of the liquid material L to the workpiece W and radiation of light can thereby be reduced and made constant. Light can also be radiated to the liquid material L until the liquid material L applied to the drawing region of the workpiece W is completely cured. Furthermore, since light is radiated from the workpiece W side to the liquid material L applied to the drawing region of the workpiece W, it is possible to prevent or minimize any impairment to the liquid material L being cured by oxygen in the air surrounding the applied liquid material L.

Moreover, light can be prevented from reaching the nozzles 411 of the droplet discharge head 40 from the light emitting part 22. Clogging of the nozzles 411, discharge problems, and other adverse effects of curing of the liquid material L near the nozzles 411 can therefore be prevented.

Each of the components constituting the stage 20 such as described above will be described sequentially and in detail.

The stage body 21 is supported by the aforementioned adjustment mechanism 33.

The stage body 21 is also plate shaped, and the light emitting part 22 is provided on one surface (top surface) thereof.

The light emitting part 22 is provided on the opposite side of the stage 20 (mounting part) from the drawing region of the workpiece W mounted on the stage 20, and is capable of emitting light to the entire drawing region.

The light emitting part 22 such as described above is provided with a plurality of light-emitting elements 221, as shown in FIGS. 4 and 5. It is thereby possible to switch between lit and unlit states for each predetermined area (each light-emitting element 221) of the light emitting part 22.

In the present embodiment, the plurality of light-emitting elements 221 is arranged in a matrix (lattice) along the top surface of the stage body 21. The arrangement of the plurality of light-emitting elements 221 is not limited to a matrix, and the light-emitting elements 221 may be in a staggered or random arrangement.

The plurality of light-emitting elements 221 is arranged in substantially the entire area of the top surface of the stage body 21.

Each of the light-emitting elements 221 is provided facing upward so as to emit the aforementioned light capable of curing the liquid material L.

The type of light-emitting elements 221 such as described above vary according to the type and other characteristics of the liquid material L, and is not particularly limited insofar as light is emitted that cures the liquid material L. For example, LED (light-emitting diode), LD (laser diode), organic EL elements, or the like may be suitably used. When the liquid material L is UV curable, for example, LED or LD elements that emit 350 to 420-nm ultraviolet rays are suitable for use.

LED or LD elements have such advantages as relatively small size, high efficiency, long service life, and low cost. Therefore, when LED or LD elements are used as the light-emitting elements 221, relatively small areas of the light emitting part 22 can be lit and unlit at a time, and light can be emitted in limited fashion from only the necessary areas. Reduced power consumption, increased service life, and reduced cost can also be anticipated in the droplet discharge device 1.

Organic EL elements can be arranged at a relatively small interval (pitch) between light-emitting elements. Therefore, when organic EL elements are used as the light-emitting elements 221, extremely small areas of the light emitting part 22 can be lit and unlit at a time, and light can be emitted in limited fashion with extreme dimensional precision from only the necessary areas.

The driving (lighting) of the light-emitting elements 221 such as described above is controlled by the control unit 60.

More specifically, the control unit 60 switches the lit and unlit state of each predetermined light-emitting element 221 of the light emitting part 22 based on the positional relationship between the droplet discharge head 40 and the stage 20, and/or the discharge pattern of droplets D by the droplet discharge head 40. The time at which and the duration over which light is directed onto the liquid material L on the workpiece W can thereby be controlled. As a result, the liquid material L on the workpiece W can be cured to the desired state. Unwanted leakage of light from the light emitting part 22 can also be prevented.

When a configuration is adopted in which the lit and unlit states of each of the light-emitting elements 221 (areas) of the light emitting part 22 are switched based on the positioning of the droplet discharge head 40 and stage 20 relative to each other, even when the droplet discharge head 40 is present over the drawing region of the workpiece W, light can be radiated to a region to which the liquid material L has been applied and from which the droplet discharge head 40 has withdrawn in the drawing region. The time between application of the liquid material L to the workpiece W and radiation of light can therefore be reduced relative to a case in which light is radiated to the liquid material L on the drawing region after the droplet discharge head 40 has withdrawn from over the drawing region (over the workpiece W).

As described above, the light emitting part 22 (light-emitting elements 221) is electrically connected to the control unit 60, and the control unit 60 can control the driving of the light emitting part 22 based on the positional relationship between the droplet discharge head 40 and the stage 20, and/or the discharge pattern of droplets D by the droplet discharge head 40.

In particular, the control unit 60 lights the light-emitting elements 221 that correspond to the region not facing the droplet discharge head 40 in the drawing region of the workpiece W (the region corresponding to the droplet discharge head 40 is unlit). The light emitting part 22 thereby radiates light via the workpiece W to the liquid material L that is on the region not facing the droplet discharge head 40 in the drawing region of the workpiece W mounted on the stage 20.

The time between application of the liquid material L to the workpiece W and radiation of light can thereby be reduced and made constant. Light can also be radiated to the liquid material L until the liquid material L applied to the drawing region of the workpiece W is completely cured. Furthermore, since light is radiated from the workpiece W side to the liquid material L applied to the drawing region of the workpiece W, it is possible to prevent or minimize any impairment to the curing of the liquid material L by oxygen in the air surrounding the applied liquid material L.

Moreover, light can be prevented from reaching the nozzles 411 of the droplet discharge head 40 from the light emitting part 22. Clogging of the nozzles 411, discharge problems, and other adverse effects of curing of the liquid material L near the nozzles 411 can therefore be prevented.

Control of the driving of the light emitting part 22 will next be described in detail.

On the light emission side of the light emitting part 22, the cover member 23 is provided via the light diffusing member 24.

The cover member 23 is plate shaped and provided so as to cover the plurality of light-emitting elements 221. Contact between the light-emitting elements 221 and the workpiece W can thereby be prevented, and damage to the light-emitting elements 221, malfunctioning, and other problems can be prevented.

The workpiece W is mounted on one surface (top surface) of the cover member 23. The top surface of the cover member 23 thus constitutes the mounting part for mounting the workpiece W. The workpiece W can thereby be stably retained (mounted).

The cover member 23 is optically transparent (e.g., the cover member 23 transmits light). The cover member 23 can thereby transmit the light from the light emitting part 22 to the workpiece W.

The material for forming the cover member 23 such as described above is not particularly limited insofar as the cover member 23 is optically transparent to the wavelength of the light from the light emitting part 22, and a glass material, crystal, resin material, or other material, for example, is suitable for use.

The cover member 23 may also be omitted.

The light diffusing member 24 is provided on the other surface (bottom surface) of the cover member 23.

The light diffusing member 24 is plate shaped or sheet shaped, and is provided so as to cover the plurality of light-emitting elements 221. In the present embodiment, one surface (top surface) of the light diffusing member 24 is joined to the (bottom surface of) the cover member 23.

The light diffusing member 24 also has the function of simultaneously transmitting and diffusing the light from the aforementioned light emitting part 22. Uneven light generation due to the directionality, arrangement density, or other characteristics of the plurality of light-emitting elements 221 of the light emitting part 22 can thereby be reduced. As a result, the liquid material L on the workpiece W can be uniformly cured throughout the entire drawing region of the workpiece W.

The light diffusing member 24 such as described above is not particularly limited, but a plate-shaped or sheet-shaped member (diffusion plate) subjected to a surface roughening treatment on one surface (top surface) thereof, for example, may be used.

The light diffusing member 24 may also be omitted depending on the degree of directionality, the arrangement density, or other characteristics of the light-emitting elements 221. The light diffusing member 24 may also be configured as a portion of the aforementioned cover member 23.

An example of the operation of the droplet discharge device 1 (droplet discharge method using the droplet discharge device 1) configured as described above will next be described. The following description is given with reference to FIG. 6, and an example is described of a case in which a pattern P is drawn (formed) in each of three regions A1, A2, A3 arranged in the X direction of the drawing region (upper portion) of the workpiece W. In the following description, the patterns P are formed in sequence from left to right (in the sequence: region A1, region A2, region A3) in the drawing region of the workpiece W.

The workpiece W is first mounted on the stage 20.

A pattern (first pattern) P is formed in region (first region) A1 of the drawing region of the workpiece W as shown in FIG. 6(*a*). In the present embodiment, the character "A" is drawn (printed) as an example of the pattern P.

At this time, the droplet discharge head 40 faces region A1 (within the range corresponding to region A1), and the liquid material L is applied to region A1 from the droplet discharge head 40 while the stage 20 and droplet discharge head 40 are moved relative to each other in the X direction and the Y direction.

The light-emitting elements 221 that correspond to region A1 are also placed in the unlit state at this time. The droplet discharge head 40 can thereby apply the liquid material L to region A1 while the light from the light emitting part 22 is prevented from reaching the droplet discharge head 40.

All of the light-emitting elements 221 of the light emitting part 22 may be placed in the unlit state at this time, or only the light-emitting elements 221 that correspond to region A1 may be unlit, and the other light-emitting elements 221 may be lit.

A pattern (second pattern) P is then formed in a region (second region) A2 different from region A1 of the drawing region of the workpiece W, as shown in FIG. 6(*b*).

At the this time, the droplet discharge head 40 faces region A2 (within the range corresponding to region A2), and the liquid material L is applied to region A2 from the droplet discharge head 40 while the stage 20 and droplet discharge head 40 are moved relative to each other in the X direction and the Y direction.

The light-emitting elements 221 that correspond to region A2 are also placed in the unlit state at this time. The droplet discharge head 40 can thereby apply the liquid material L to region A2 while the light from the light emitting part 22 is prevented from reaching the droplet discharge head 40.

Furthermore, the light-emitting elements 221 that correspond to region A1 in which drawing is already completed are placed in the lit state at this time. Light can thereby be promptly radiated to the liquid material L (pattern P) on the already drawn region A1 after drawing has occurred.

Only the light-emitting elements 221 corresponding to region A1 may be lit at this time, or only the light-emitting elements 221 corresponding to region A2 may be unlit, and the other light-emitting elements 221 may be lit. In the present embodiment, only the light-emitting elements 221 corresponding to region A1 are lit, and the lit region of the light emitting part 22 is indicated by diagonal lines in FIG. 6.

In this manner, among the plurality of light-emitting elements 221 (plurality of areas) of the light emitting part 22, the light-emitting elements 221 (areas) facing the droplet discharge head 40 are placed in the unlit state, and the light-emitting elements 221 (areas) not facing the droplet discharge head 40 are placed in the lit state.

Light can thereby be radiated to the liquid material L applied to the drawing region, while the light from the light emitting part 22 is prevented from reaching the nozzles 411 of the droplet discharge head 40.

The light emitting part 22 turns off the light-emitting elements 221 (areas) corresponding to region A1 during formation of the pattern P in region A1, and lights the light-emitting elements 221 (areas) corresponding to region A1 during formation of the pattern P in region A2, and the time between application of the liquid material L to region A1 and radiation of light can thereby be reduced. In particular, since region A1 and region A2 are adjacent to each other, the time between application of the liquid material L to region A1 and radiation of light can be further reduced. Light can also be radiated to the liquid material L until the liquid material L applied to region A1 is completely cured.

A plurality of (numerous) light-emitting elements 221 is provided in the areas corresponding to regions A1 through A3 in the light emitting part 22 in this arrangement, but the lit and unlit states of the light-emitting elements 221 can be controlled based on the drawing pattern of the liquid material L formed on the drawing region.

In this case, the area of the light emitting part 22 that corresponds to the drawing pattern (only the area in which light radiation is needed) can be lit. For example, the light-emitting elements 221 can be lit to create a lighting pattern that corresponds to the pattern P. The light from the light emitting part 22 can therefore be more reliably prevented from reaching the nozzles 411 of the droplet discharge head 40.

A pattern (third pattern) P is then formed in region (third region) A3 of the drawing region of the workpiece W, as shown in FIG. 6(*c*).

At the this time, the droplet discharge head 40 faces region A3 (within the range corresponding to region A3), and the liquid material L is applied to region A3 from the droplet discharge head 40 while the stage 20 and droplet discharge head 40 are moved relative to each other in the X direction and the Y direction.

The light-emitting elements 221 that correspond to region A3 are also placed in the unlit state at this time. The droplet discharge head 40 can thereby apply the liquid material L to region A3 while the light from the light emitting part 22 is prevented from reaching the droplet discharge head 40.

Furthermore, the light-emitting elements 221 that correspond to region A2 in which drawing is already completed are placed in the lit state at this time. Light can thereby be promptly radiated to the liquid material L (pattern P) on the already drawn region A2 after drawing has occurred.

Only the light-emitting elements 221 corresponding to region A2 may be lit at this time, or only the light-emitting elements 221 corresponding to region A3 may be unlit, and the other light-emitting elements 221 may be lit. In the present embodiment, during formation of the pattern P in region A3, the light-emitting elements 221 corresponding to region A1 and the light-emitting elements 221 corresponding to region A2 are each lit. The liquid material L on region A1 can thereby be more reliably cured.

After formation of the pattern P in region A3, the droplet discharge head 40 is returned to a position not facing the drawing region of the workpiece W.

The light-emitting elements 221 corresponding to region A3 are then placed in the lit state. At this time, only the light-emitting elements 221 corresponding to region A3 may be lit, or the light-emitting elements 221 corresponding to region A1 and/or region A2 may be lit.

Three patterns P are formed on the drawing region of the workpiece W in the manner described above.

Three patterns P such as described above can be formed in the same manner in the regions below and adjacent to regions A1 through A3. At this time, the droplet discharge head 40 may be returned to the left side of the workpiece W and the patterns P formed in sequence from left to right in the drawing region of the workpiece W, or the patterns P may be formed from right to left in the drawing region of the workpiece W without the droplet discharge head 40 being returned to the left side of the workpiece W.

The film thickness of the formed patterns P can be increased by applying the liquid material L again (in overlapping fashion) on the already drawn regions A1 through A3 and performing light radiation in the same manner as described above. A pattern P having an arbitrary film thickness that corresponds to the number of repetitions can be obtained by repeatedly applying the liquid material L to the same regions and radiating the light. In this case, since the applied liquid material L can be instantly photo-cured each time the liquid material L is applied, it is possible to form films (layers) having a high aspect ratio and excellent dimensional precision.

Through the droplet discharge device 1 and droplet discharge method (droplet discharge method of the present invention) according to the first embodiment such as described above, the time between application of the liquid material L to the workpiece W and radiation of light can thereby be reduced and made constant. Light can also be radiated to the liquid material L until the liquid material L applied to the drawing region of the workpiece W is completely cured. Furthermore, since light is radiated from the workpiece W side to the liquid material L applied to the drawing region of the workpiece W, it is possible to prevent or minimize any impairment to the liquid material L being cured by oxygen in the air surrounding the applied liquid material L.

Moreover, light can be prevented from reaching the nozzles 411 of the droplet discharge head 40 from the light emitting part 22. Clogging of the nozzles 411, discharge problems, and other adverse effects of curing of the liquid material L near the nozzles 411 can therefore be prevented.

The droplet discharge device 1 and droplet discharge method of the present embodiment therefore make it possible to realize highly precise droplet discharge using a photo-curable liquid material L.

Second Embodiment

A second embodiment of the droplet discharge device of the present invention will next be described.

Figure 7:
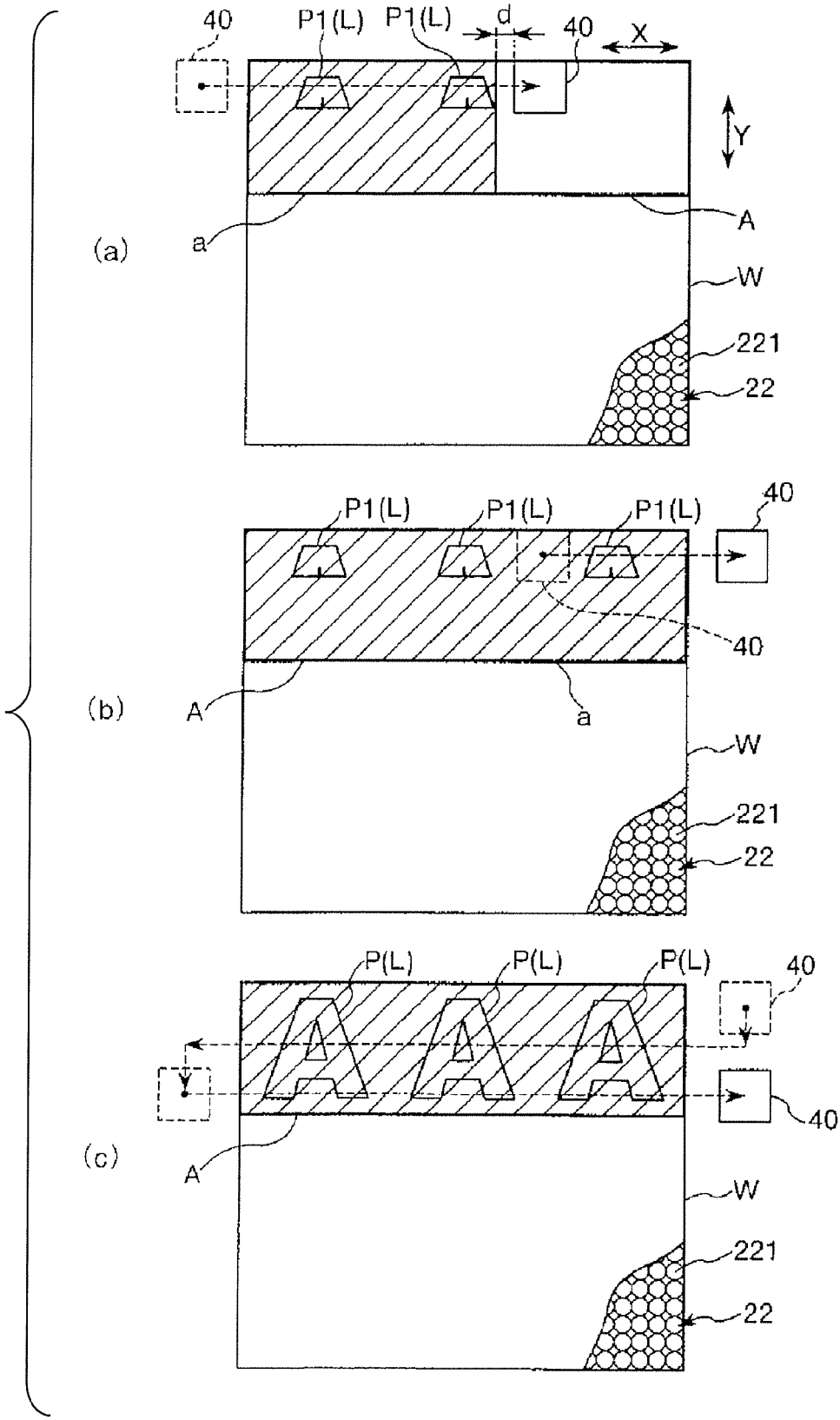
FIG. 7 is a view showing the operation of the stage (light radiating unit) according to a second embodiment of the present invention.

FIG. 7 is a view showing the operation of the stage (light radiating unit) according to a second embodiment of the present invention.

The droplet discharge device of the present embodiment is the same as the droplet discharge device of the first embodiment described above, except for the method of controlling the light radiating unit (light emitting part).

The following description will focus on the aspects of the droplet discharge device of the second embodiment that differ from those of the droplet discharge device of the first embodiment, and no overlapping descriptions will be given.

In the present embodiment, an example is described of a case in which three patterns P aligned in the X direction are drawn in the drawing region of the workpiece W by scanning the droplet discharge head 40 three times (one and a half round-trip scans) in the X direction with respect to the drawing region of the workpiece W. In this instance, the droplet discharge head 40 moves to a new line in the Y direction with respect to the drawing region with each scan in the X direction.

First, the workpiece W is mounted on the stage 20.

The first scan of the droplet discharge head 40 in the X direction is then performed for region A of the drawing region of the workpiece W.

At this time, the light-emitting elements 221 corresponding to the portion of region A that faces the droplet discharge head 40 are placed in the unlit state, as shown in FIG. 7(*a*). The light-emitting elements 221 corresponding to the region a further behind the droplet discharge head 40 in the movement direction thereof than the portion of region A facing the droplet discharge head 40 are placed in the lit state. This region a increases in size as the droplet discharge head 40 moves, but region a increases in size while the distance d between region a and the droplet discharge head 40 is maintained. As shown in FIG. 7(*b*), when the first scan is completed, the droplet discharge head 40 is returned to a position not facing the drawing region of the workpiece W, and region a and region A coincide. In FIG. 7, the lit region of the light emitting part 22 is indicated by diagonal lines.

The time between application of the liquid material in region A from the droplet discharge head 40 and the start of radiation of light to the liquid material can thereby be made extremely short and constant.

Three patterns P1 that form portions of the three patterns P are formed by the first scan of the droplet discharge head 40 in the X direction as described above.

At this time, the light-emitting elements 221 behind the droplet discharge head 40 in the movement direction thereof may be lit until the start of the second scan of the droplet discharge head 40 in the X direction, or the light-emitting elements 221 may be turned off after being on for a predetermined time so that the lit time of each of the light-emitting elements 221 is the same.

The droplet discharge head 40 can thus apply the liquid material L to region A while the light from the light emitting part 22 is prevented from reaching the droplet discharge head 40.

Then, after the droplet discharge head 40 is moved in the Y direction (downward in FIG. 7) to a new line with respect to the workpiece W, the droplet discharge head 40 scans a second time in the X direction in the same manner as described above.

After the droplet discharge head 40 is again moved in the Y direction (downward in FIG. 7) to a new line with respect to the workpiece W, the droplet discharge head 40 scans a third time in the X direction in the same manner as described above.

Three patterns P are thus formed on the drawing region of the workpiece W.

The same effects as those produced by the droplet discharge device 1 of the first embodiment can be demonstrated by the droplet discharge device and droplet discharge method of the second embodiment such as described above.

The droplet discharge device and droplet discharge method of the present invention are described above based on the embodiments shown in the drawings, but the present invention is not limited by these embodiments.

The configurations of each component of the droplet discharge device and droplet discharge method of the present invention may also be substituted with any configuration that demonstrates the same function, and any configuration may also be added.

Any of the configurations of the embodiments described above may also be combined in the droplet discharge device and droplet discharge method of the present invention, for example.

In the embodiments described above, the light emitting part 22 was described as being composed of a plurality of light-emitting elements 221, but this configuration is not limiting, and the light emitting part 22 may also be formed by connecting a light source to the ends of a plurality of optical fibers or other light guides and arranging the other ends on the stage body 21, for example.

In this case, the light source is not particularly limited insofar as a wavelength and intensity of light capable of curing the liquid material L is emitted, and various light sources can be used, but when the liquid material L is UV-curable, for example, a mercury lamp, metal halide lamp, excimer laser, YAG laser, LED (UV-LED), LD (UV-LD), or other light source may be used.

A case was described in the embodiments above in which the light emitting part 22 is switched between lit and unlit states for each predetermined area, but the light emitting part 22 may also be completely lit or unlit. In this case, the light emitting part 22 is in the unlit state when the droplet discharge head 40 is over the drawing region of the workpiece W, and the light emitting part 22 is in the lit state when the droplet discharge head 40 is withdrawn from over the drawing region of the workpiece W (when returned to the area outside the drawing region).

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A droplet discharge device comprising:

a droplet discharge head including a plurality of nozzles configured and arranged to discharge droplets of photocurable liquid material toward a drawing region on a surface of a light transmissive panel-shaped or sheet-shaped workpiece;

a stage configured and arranged to mount the workpiece, the stage including a stage body and a light radiating unit having a light emitting part disposed on a top surface of the stage body facing a side of the workpiece opposite from the surface on which the liquid material is applied; and a movement unit configured and arranged to move the stage and the droplet discharge head relative to each other so that the droplet discharge head applies the liquid material on a portion of the drawing region and then moves away from a position over the portion of the drawing region;

the light emitting part being capable of emitting light to an entire area of the drawing region, the light emitting part being configured and arranged not to emit the light to the portion of the drawing region when the droplet discharge head is disposed at the position over the portion of the drawing region, and to emit the light to the portion of the drawing region to cure the liquid material applied on the portion of the drawing region when the droplet discharge head has moved away from the position over the portion of the drawing region.

2. The droplet discharge device according to claim 1, wherein the light emitting part is capable of selectively switching between a lit state and an unlit state with respect to each of a plurality of areas of the light emitting part, and configured and arrange to selectively switch between the lit state and the unlit state at each of the areas based on positioning of the droplet discharge head and the stage relative to each other.

3. The droplet discharge device according to claim 2, wherein the light emitting part is configured and arranged to set at least one of the areas facing the droplet discharge head in the unlit state, and to set at least one of the areas not facing the droplet discharge head in the lit state.

4. The droplet discharge device according to claim 3, wherein the droplet discharge head is configured and arranged to apply the liquid material on a first region of the drawing region to form a first pattern, then to apply the liquid material on a second region different from the first region of the drawing region to form a second pattern, and the light emitting part is configured and arranged to set at least one of the areas corresponding to the first region in the unlit state while the first pattern is being formed by the droplet discharge head, and to set the at least one of the areas corresponding to the first region in the lit state while the second pattern is being formed by the droplet discharge head.

5. The droplet discharge device according to claim 4, wherein the first region and the second region are adjacent to each other.

6. The droplet discharge device according to claim 2, wherein the light emitting part has a plurality of light-emitting elements.

7. The droplet discharge device according to claim 6, wherein the light emitting part is configured and arranged to control lighting and non-lighting of each of the light-emitting elements based on a drawing pattern of the liquid material formed on the drawing region.

8. The droplet discharge device according to claim 6, further comprising a light transmissive cover member covering the light-emitting elements, a surface of the cover member opposite from a surface facing the light-emitting elements forming the mounting part of the stage.

9. The droplet discharge device according to claim 6, further comprising a light-diffusing member covering the light-emitting elements, and configured and arranged to diffuse light emitted from the light-emitting elements.

10. The droplet discharge device according to claim 1, wherein the light radiating unit and the droplet discharge head are configured and arranged to repeatedly alternate between application of the liquid material by the droplet discharge head to the workpiece and emission of light by the light radiating unit.

11. A droplet discharge method comprising:

mounting a light transmissive panel-shaped or sheet-shaped workpiece on a stage, the stage including a stage body and a light radiating unit having a light emitting part disposed on a top surface of the stage body facing a side of the workpiece opposite from a surface on which a photo-curable liquid material is to be applied;

applying the liquid material discharged as droplets from a plurality of nozzles of a droplet discharge head on a portion of a drawing region on a surface of the workpiece mounted on the stage while the stage and the droplet discharge head are moved relative to each other;

moving the droplet discharge head away from over the portion of the drawing region after the liquid material is applied on the portion of the drawing region; and radiating light for curing the liquid material toward the portion of the drawing region from the side of the workpiece opposite from the surface on which the liquid material is applied, in a state in which the droplet discharge head is moved away from the position over the portion of the drawing region.

* * * * *